United States Patent [19]

Nishiyama

[11] Patent Number: 4,683,192

[45] Date of Patent: Jul. 28, 1987

[54] SILVER HALIDE PHOTOGRAPHIC EMULSIONS AND PROCESS FOR PRODUCING THEM

[75] Inventor: Shingo Nishiyama, Kanagawa, Japan

[73] Assignee: Fuji Photo Film Co., Ltd., Kanagawa, Japan

[21] Appl. No.: 725,285

[22] Filed: Apr. 19, 1985

[30] Foreign Application Priority Data

Apr. 19, 1984 [JP] Japan ..... 59-79160

[51] Int. Cl.[4] ..... G03C 1/02; G03C 1/06

[52] U.S. Cl. ..... 430/567; 430/569; 430/603; 430/605

[58] Field of Search ..... 430/567, 569, 603, 605

[56] References Cited

U.S. PATENT DOCUMENTS 3,156,564 11/1964 von Wartburg ..... 430/614
3,689,270 9/1972 Anderson et al. ..... 430/615
3,817,756 6/1974 Claes et al. ..... 430/567
4,400,463 8/1983 Maskasky ..... 430/567

FOREIGN PATENT DOCUMENTS 2932185 2/1980 Fed. Rep. of Germany .

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A silver halide photographic emulsion containing silver halide grains, the surface of which is a (110) crystal plane substantially composed of silver bromide or silver iodobromide is disclosed. A process for producing a silver halide photographic emulsion containing silver halide grains the surface of which is substantially composed of silver bromide or silver iodobromide, which comprises performing growth of the silver halide grains in an aqueous medium in the presence of a hydrophilic protective colloid and a compound accelerating the development of a (110) crystal plane is also disclosed.

7 Claims, 16 Drawing Figures

SILVER HALIDE PHOTOGRAPHIC EMULSIONS AND PROCESS FOR PRODUCING THEM

FIELD OF THE INVENTION

This invention relates to a silver halide photographic emulsion containing novel silver bromide or silver iodobromide grains and a process for the production thereof. More specifically, the invention relates to a silver halide photographic emulsion containing novel silver bromide or silver iodobromide grains having the (110) crystal plane and a process for the production thereof.

BACKGROUND OF THE INVENTION

It is known to prepare light-sensitive silver halide crystals by a precipitation method using a water-soluble halide and a water-soluble silver salt in the presence of a protective colloid.

Also, it is known as described in, for example, H. Frieser, et al., *Die Grundlagen der Photographischen Prozesse mit Silberhalogeniden,* pages 631–640 (published by Akademische Verlagsgesellschaft, 1968) that the environmental conditions for forming the precipitates influence the crystal appearance of silver halide grains.

A technique capable of being applied to control the crystal appearance of silver bromide is generally described in *PS & E Journal,* Vol. 12, pages 207–212 (1968) by F. H. Claes and W. Peelaers. This report describes in detail the transfer of the positive or twin isometric system of silver bromide having the {100} crystal appearance specified by the (100) plane into an octahedron system having the {111} habit and the (111) plane.

Hitherto, for silver bromide emulsions or silver iodobromide emulsions, silver halide grains composed of the (100) crystal plane and/or the (111) crystal plane have been studied and used.

As a silver halide emulsion having the (110) crystal plane, a silver chloride emulsion or a silver chlorobromide emulsion is known. For example, Japanese Patent Publication No. 42737/80 describes a silver chloride emulsion and also a silver chlorobromide emulsion containing 50 mol % or 75 mol % silver bromide. However, there is no description about a silver bromide emulsion or silver iodobromide emulsion having the (110) crystal plane in the patent publication.

Also, West German Patent Application (OLS) No. 2,932,185 describes silver chloride grains having the (110) plane but there is no description about a silver bromide emulsion and silver iodobromide emulsion having the (110) plane in the specification of the patent application.

Also, there is a description about silver bromide grains which are said to simultaneously have the (111) plane, the (100) plane and the (110) plane in *Photo. Sci. Eng.,* 19 (3), 21 (1975) but there is no description of the evidence used to identify that the plane is the (110) plane. The only evidence is from photographs attached to the report. Furthermore, from the photographs of the silver halide grains, it is difficult to determine whether the silver bromide grains are a rhombic dodecahedron or not. Even if the silver bromide grains may contain the (110) plane, it is simply assumed that the occupying ratio of the (110) plane to the whole grain surfaces is very small. Also, there is only the description about the method of preparation of the silver bromide grains but the utilization of the silver bromide grains as a photographic silver halide emulsion is not described in the aforesaid report.

Moreover, in the above-described report, the physical ripening of the silver halide grains is performed in the presence of pyridine but pyridine does not have the function of sufficiently growing the (110) plane. Thus, it can be said that the silver bromide grains disclosed in the above report do not belong to the category of the silver halide grains in the present invention.

Thus, the silver bromide emulsion and the silver iodobromide emulsion each having the (110) plane have not been known before our invention.

SUMMARY OF THE INVENTION

An object of this invention is, therefore, to provide a silver halide photographic emulsion containing silver bromide grains or silver iodobromide grains having a new crystal plane.

Another object of this invention is to provide a process for producing the above-described silver halide photographic emulsion.

Thus, according to this invention, there is provided a silver halide photographic emulsion containing silver halide grains at least the surface of which is the (110) crystal plane substantially composed of silver bromide or silver iodobromide.

The above-described silver halide photographic emulsion can be obtained by the process of this invention. That is, according to another embodiment of this invention, there is provided a process for producing a silver halide photographic emulsion wherein the surface of the silver halide grains is substantially composed of silver bromide or silver iodobromide, which comprises forming the silver halide grains in an aqueous medium in the presence of a hydrophilic protective colloid and at least one compound capable of accelerating the development of the (110) crystal plane.

DETAILED DESCRIPTION OF THE INVENTION

Figure 1:
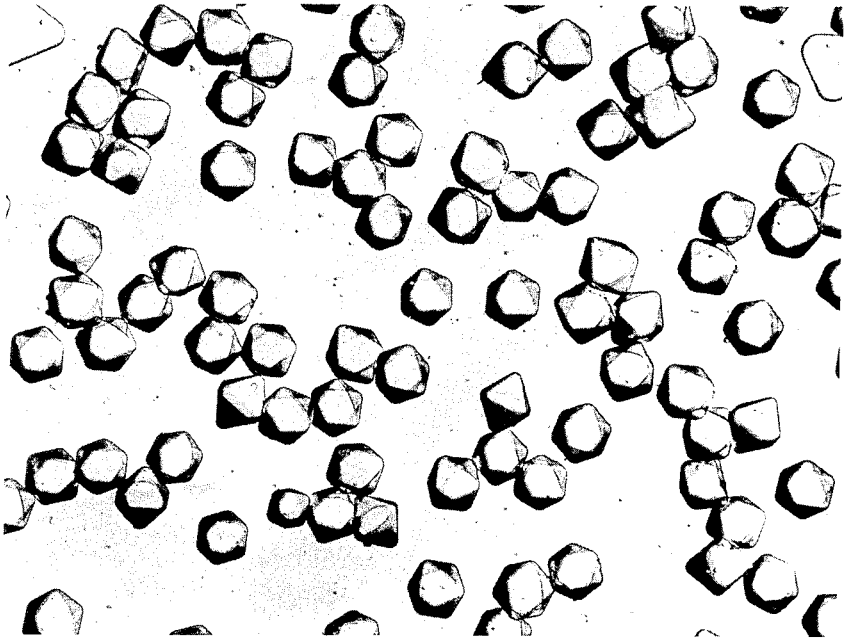
FIG. 1 is the electronmicroscopic photograph of 10,000 magnification of silver halide emulsion A containing regular octahedral silver bromide grains composed of the (111) crystal plane produced in Example 2.

As a result of inventors' investigations, it has been found that when a compound which has hitherto been considered to inhibit the growth of silver halide grains is used in the step of forming silver halide grains, the compound shows an astonishing effect of developing the (110) crystal plane.

For example, 1-phenyl-5-mercaptotetrazole has hitherto been known to have the function of stopping the growth of silver halide grains, but when formation of silver bromide grains or silver iodobromide grains is further performed in the presence of 1-phenyl-5-mercaptotetrazole, the development of the (110) crystal plane is greatly accelerated, whereby a silver halide photographic emulsion containing silver bromide grains or silver iodobromide grains having the (110) crystal plane can be obtained.

By using the silver halide photographic emulsion containing silver halide grains the surface of which is substantially composed of silver bromide or silver iodobromide having the (110) crystal plane, various merits as photographic emulsions, which have never been obtained by a conventional silver bromide or silver iodobromide emulsion having no (110) crystal plane, can be obtained.

For example, (1) The above-described silver halide emulsion can restrain the formation of fog as compared to a conventional silver bromide emulsion or silver iodobromide emulsion having the (111) plane or the (100) plane.

(2) The above-described silver halide emulsion has a spectrally sensitizing faculty completely different from that of a conventional silver halide emulsion having the (111) plane or the (100) plane. For example, in the silver halide emulsion of this invention, the spectrally sensitized spectral sensitivity spectra can be shaped into a rectangular form. Accordingly, in the case of using the foregoing silver halide emulsions of this invention, the color reproducibility can be remarkably improved and the occurrence of color mixing can be remarkably prevented.

(3) Since the spectral sensitivity spectra of the foregoing silver halide emulsion of this invention can be shaped into a rectangular form, when the photographic material having the silver halide emulsion layer is exposed using LED (light emitting diode) the wavelength of which is liable to shift by the surrounding temperature, a stable exposure can be applied.

The compounds capable of accelerating the development of the (110) plane (hereinafter, is referred to as "crystal control compounds") for use in this invention cannot clearly be chemically classified but the compounds can be expediently selected by a physical retardance measurement as will be explained hereinafter.

In this invention, the compounds having a large physical retardance can be preferably used.

That is, as the crystal control compounds for use in this invention, the compounds having a physical retardance of at least 70 in the physical retardance measuring method as described below are preferred, the compounds having a physical retardance of at least 80 are more preferred, and the compounds having a physical retardance of at least 90 are particularly preferred.

In this case, the physical retardance of a compound changes according to the pH value for measuring it, but the compounds having a physical retardance of at least 70 at the pH value in the condition for preparing the silver halide grains can be used in this invention. Silver halide grains are usually prepared in the pH range of 2 to 12.

In the physical retardance measuring method in this invention, a test compound is added to the gelatin solution based on the method described in *Photographic Gelatin Test Method -PAGI Method-*, pages 19 to 20, edited by Photographic Gelatin Test Method Joint Council (5th Ed., October, 1982) and then the physical retardance can be measured.

Practically, the physical retardance measuring method can be performed as follows.

| Physical Retardance Measuring Method: | |
|---|---|
| Liquid A: | |
| Inert Gelatin | 10 g |
| Sodium Chloride | 0.70 g |
| Distilled Water | 110 ml |
| Test Compound | $1.6 \times 10^{-4}$ mol |
| pH adjusted to 5.0 with 1 N sulfuric acid | |
| Liquid B: | |
| Aqueous 0.1 N Silver Nitrate Solution | 40 ml |

After adding Liquid B of about 60° C. to Liquid A of 60.0±0.5° C. stirred well in 3 seconds, the mixture is digested for 20 minutes at 60.0±0.5° C. Thereafter, 5 ml of the mixture is collected, added to 50 ml of distilled water at room temperature followed by stirring to provide a testing liquid, and the transmittance thereof is measured by a turbidity indicator, ANA 14Z Type (trade name, made by Tokyo Koden K.K.).

Now, the term "physical retardance" (physical inhibition) in this specification means the value of the transmittance (percent) of a testing liquid when the transmittance of distilled water used in place of the testing liquid is defined to be 100%.

Practically speaking, when the transmittance of the above-described testing liquid containing a test compound is 80.0%, the physical retardance of the compound is 80.0.

The above measuring method is for pH 5 but the measurement may be performed at other pH values. That is, in the case of performing the measurement at, for example, pH 8, the pH of Liquid A is adjusted to 8 using an aqueous 1 N sodium hydroxide solution in place of 1 N sulfuric acid and the same procedure as above may be performed using the Liquid A.

As the crystal control compounds for use in this invention, there are preferably mercaptoazoles having a large physical retardance, more preferably mercaptotetrazoles and mercaptothiadiazoles having a large physical retardance.

More specifically, as the crystal control compounds for use in this invention, the compounds shown by the following general formulae (I) to (V) are preferred:

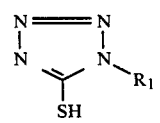

(I)

wherein $R_1$ represents a hydrogen atom, a substituted or unsubstituted alkyl group (having 15 or less than 15 carbon atoms), a substituted or unsubstituted aryl group (having 20 or less than 20 carbon atoms), or a heterocyclic ring group.

Examples of the alkyl group shown by $R_1$ are straight chain or branched alkyl groups such as a propyl group, a butyl group, etc.; cyclic alkyl groups such as a cyclohexyl group, etc.; and an adamantyl group.

Examples of the aryl group shown by $R_1$ are a phenyl group, a naphthyl group, etc. Also, examples of the heterocyclic ring group shown by $R_1$ are 4- to 6-membered cyclic ring groups having a nitrogen atom, an oxygen atom, etc., such as a 3-pyridyl group, etc.

Examples of the substituent for the above groups are an alkyl group, an aryl group, an alkoxy group, a carboxy group, a sulfo group, a hydroxy group, an amino group, a substituted amino group, a halogen atom, a nitro group, an alkylcarbonyl group, an alkoxycarbonyl group, etc.

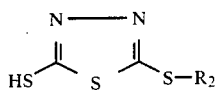
(II)

wherein $R_2$ represents a hydrogen atom or a substituted or unsubstituted alkyl group (having 12 or less than 12 carbon atoms). Examples of the alkyl group are a methyl group, an ethyl group, a propyl group, a butyl group, etc. Also, examples of the substituent for the alkyl group are an alkyl group, an aryl group, an alkoxy group, a carboxy group, a sulfo group, a hydroxy group, an amino group, a substituted amino group, a halogen atom, a nitro group, an alkylcarbonyl group, an alkoxycarbonyl group, etc.

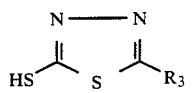
(III)

wherein $R_3$ represents a substituted or unsubstituted alkyl group (having 10 or less than 10 carbon atoms), or a substituted or unsubstituted amino group (having 10 or less than 10 carbon atoms).

Examples of the aforesaid substituent are an alkyl group, an alkylcarbonyl group, an alkoxycarbonyl group, etc.

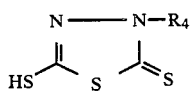
(IV)

wherein $R_4$ represents a substituted or unsubstituted alkyl group (having 10 or less than 10 carbon atoms), or a substituted or unsubstituted aryl group (having 10 or less than 10 carbon atoms).

Examples of the aforesaid substituent are a sulfo group, etc.

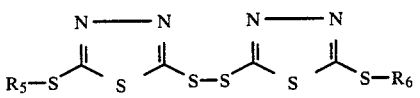
(V)

wherein $R_5$ and $R_6$ each represents a substituted or unsubstituted alkyl group (having 10 or less than 10 carbon atoms), or a substituted or unsubstituted amino group (having 10 or less than 10 carbon atoms).

Examples of the substituent for the above groups are a hydroxy group, a lower alkyl group, etc.

Specific examples of the crystal control compounds for use in this invention are illustrated below.

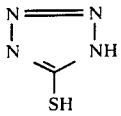
(1)

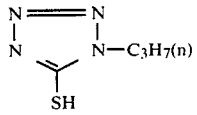
(2)

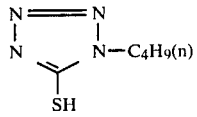
(3)

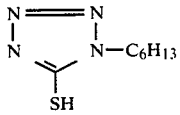
(4)

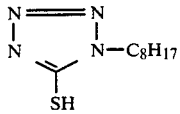
(5)

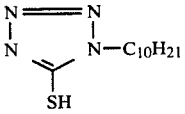
(6)

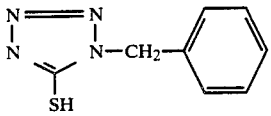
(7)

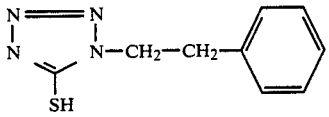
(8)

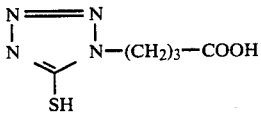
(9)

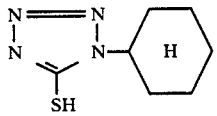
(10)

-continued
(11)
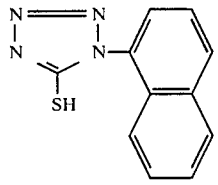
(12)
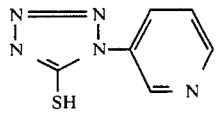
(13)
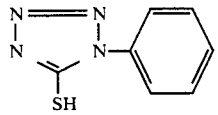
(14)
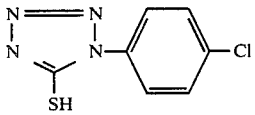
(15)
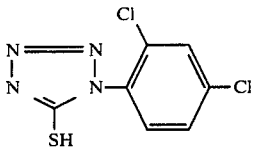
(16)
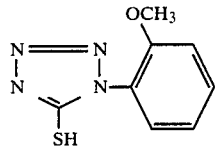
(17)
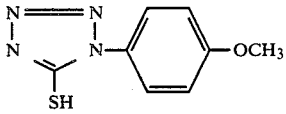
(18)
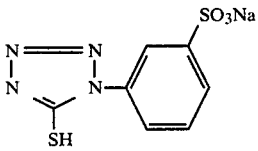
(19)
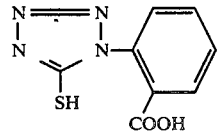
(20)
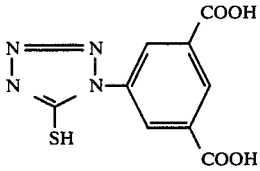
-continued
(21)
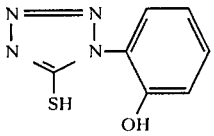
(22)
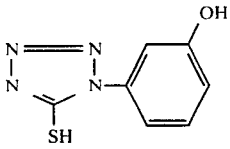
(23)
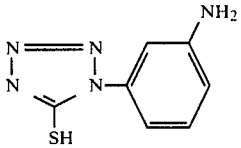
(24)
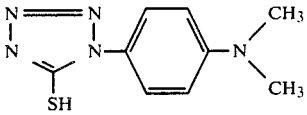
(25)
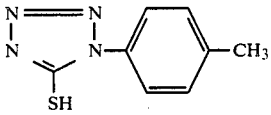
(26)
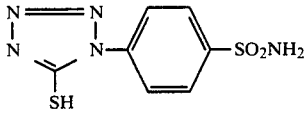
(27)
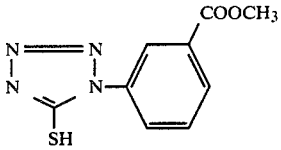
(28)
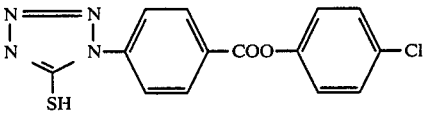
(29)
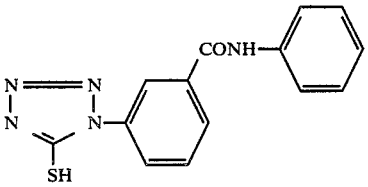
(30)
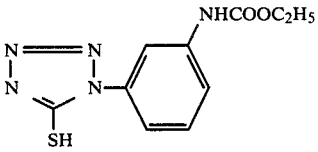

-continued
(31)
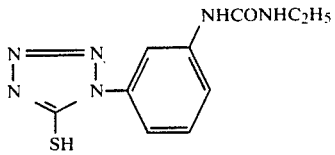
(32)
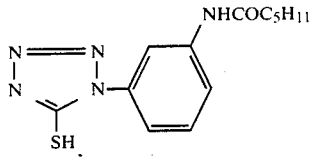
(33)
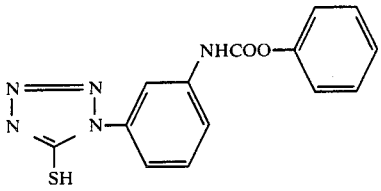
(34)
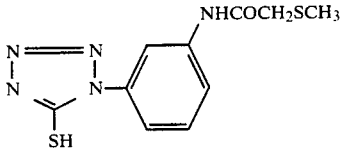
(35)
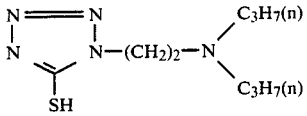
(36)
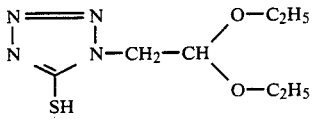
(37)
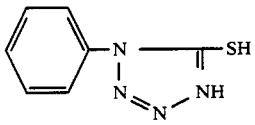
(38)
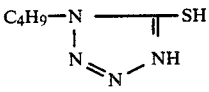
(39)
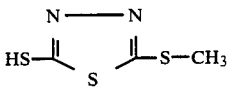
(40)
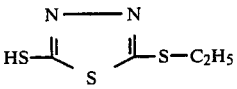
(41)
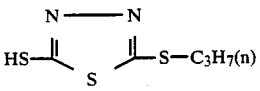
(42)
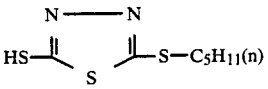
-continued
(43)
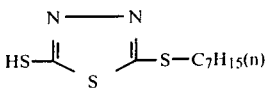
(44)
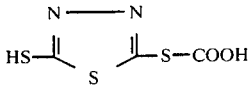
(45)
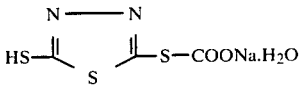
(46)
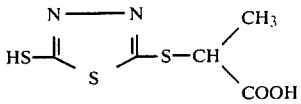
(47)
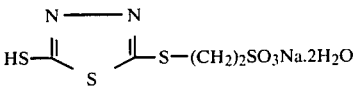
(48)
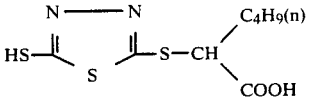
(49)
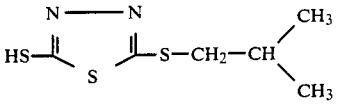
(50)
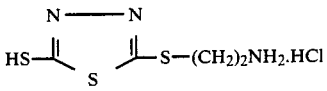
(51)
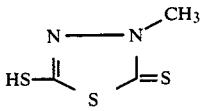
(52)
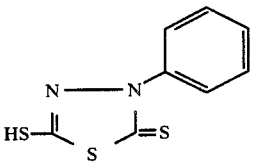
(53)
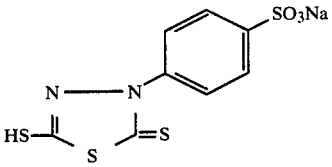
(54)
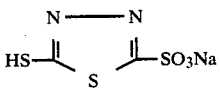
(55)
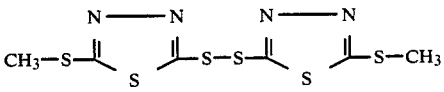

-continued (56)

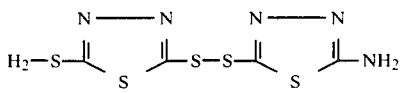

(57)

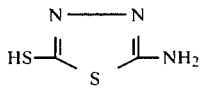

(58)

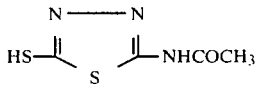

(59)

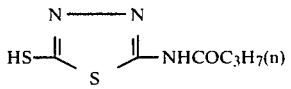

(60)

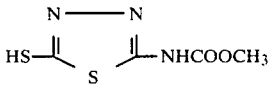

(61)

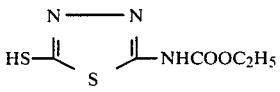

The compounds of the formulae (I) to (V) are well known in this art and the synthesis thereof is known to one skilled in the art.

The crystal control compound for use in this invention may be added to a silver halide emulsion at any time before the completion (including the completion of Oswald ripening) of the formation of silver halide grains. The period of forming silver halide grains is from the initiation of the addition of a silver ion and a halogen ion to the time when the further formation of the new crystal nuclei is substantially stopped (nucleus forming period) and the period when the silver halide grains grow without substantially forming new crystal nuclei following the nucleus forming period.

It is preferred to add the crystal control compound during the growth of silver halide grains. It is particularly preferred for restraining the formation of a large amount of fine grains to add the crystal control compound after the completion of the formation of crystal nuclei (nucleus formation) and before the completion of the growth of the grains.

Also, in contrast with above, it is preferred in the case of preparing silver halide grains composed of fine grains to add the crystal control compound in this invention at or before the formation of the crystal nuclei.

The crystal control compound for use in this invention may previously exist in a reaction vessel for forming silver halide grains or may be added after the initiation of the precipitation of silver halide grains. In this case, the compound may be added directly or may be added as a solution in water or an organic solvent such as methanol, ethanol, etc.

Also, the crystal control compound for use in this invention may be added to the reaction system solely or may be added to the reaction system together with a silver supplying solution (e.g., an aqueous silver nitrate solution) and a halogen supplying solution (e.g., an aqueous halide solution).

In the case of adding the crystal control compound for use in this invention, the compound may be added continuously or intermittently. It is preferred for effectively controlling the growth of the crystal plane to increase the amount of the crystal control compound of this invention (e.g., increasing the addition amount of the solution of this compound or increasing the concentration of the compound in the solution) according to the increase of the surface area of the silver halide grains.

The occupying ratio of the (110) plane of the silver halide grains having the (110) plane in this invention can be easily changed by changing the addition amount of the crystal control compound.

For example, the ratio of the (110) plane is increased with the increase of the addition amount of the crystal control compound, the ratio of the (110) plane becomes maximum in the addition amount range of the compound as will be described hereinafter, and if the addition amount of the crystal control compound is further increased beyond the aforesaid range, the ratio of the (100) plane to the (110) plane is increased.

The addition amount of the crystal control compound for use in this invention depends upon the nature of the compound used, the production condition for the silver halide emulsion, the halogen composition of the silver halide emulsion, the grain size of the silver halide grains, etc., but is preferably $5\times10^{-5}$ to $5\times10^{-2}$ mol per mol of the silver halide, more preferably $1\times10^{-4}$ to $1\times10^{-2}$ mol per mol of the silver halide, most preferably $3\times10^{-4}$ to $6\times10^{-3}$ mol per mol of the silver halide.

The surface of the silver halide grains in this invention has the (110) plane. In this case, the occupying ratio of the (110) plane to the whole area of the silver halide grains is preferably at least 20%, more preferably at least 80%.

Also, the existence and the ratio of the (110) plane of silver halide grains can be confirmed by an electronmicroscope or a dye absorption method.

The proportion of the silver halide grains having the (110) plane in the silver halide emulsion for use in this invention is, preferaly at least 30% by weight, more preferably at least 50% by weight based on total weight of grains.

Silver halide grains substantially composed of silver bromide grains or silver iodobromide grains the surface of which has the (110) plane can be used in this invention. The silver halide grains for use in this invention may have a single composition or may be composed of plural layers or phases (2 layers or 3 layers) each having a different halogen composition. When the silver halide grains for use in this invention do not have a single or homogeneous composition, the halogen composition of the inner layer(s) of the silver halide grains may not only be silver bromide or silver iodobromide but also silver chloride, silver chlorobromide, etc.

The term "substantially" is to be understood as meaning that the silver halide grains may further contain silver chloride in addition to silver bromide or silver iodobromide. More practically, the silver halide grains for use in this invention may contain less than 10 mol %, preferably less than 5 mol % silver chloride.

It is preferred for increasing the sensitivity of the silver halide emulsion itself to remove the crystal control compound existing on the surfaces of the silver halide grains after the formation thereof by washing with water or to heat-decompose the crystal control compound by heating. However, the crystal control compound may be present in the silver halide emulsion which is finally coated on a support for providing a photographic material.

As a hydrophilic colloid which is used for the silver halide emulsions in this invention, gelatin is advantageously used but other hydrophilic colloids may be used.

Examples of such hydrophilic colloids are gelatin derivatives; graft polymers of gelatin and other polymers; proteins such as albumin, casein, etc.; cellulose derivatives such as hydroxyethyl cellulose, carboxymethyl cellulose, cellulose sulfuric acid esters, etc.; sugar derivatives such as sodium alginate, starch derivatives, etc.; and various synthetic high molecular weight materials such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, limed gelatin as well as acid-treated gelatin and enzyme-treated gelatin as described in *Bull. Soc. Sci. Phot. Japan*, No. 16, page 30 (1966) can be used. Furthermore, the hydrolyzed product and enzyme-decomposition product of gelatin may be used.

As the gelatin derivatives, there are various reaction products of gelatin and various compounds such as acid halides, acid anhydrides, isocyanates, bromoacetic acid, alkanesultones, vinylsulfonamides, maleinimide compounds, polyalkylene oxides, epoxy compounds, etc.

When the silver halide grains for use in this invention are composed of silver iodobromide grains, the content of silver iodide is preferably less than 40 mol %, more preferably less than 20 mol % to the whole grains.

When the silver halide grains for use in this invention are composed of plural layers each having a different halogen composition, the silver halide in the inside thereof may be silver bromide, silver iodide, silver chloride, silver iodobromide, silver chlorobromide, silver chloroiodobromide, etc.

The silver halide photographic emulsions for use in this invention can be fundamentally prepared by the methods described in, for example, Glafkides, *Chimie et Physique Photographique* (published by Paul Montel Co., 1967), G. F. Duffin, *Photographic Emulsion Chemistry* (published by the Focal Press, 1966), V. L. Zelikman et al., *Making and Coating Photographic Emulsion* (published by The Focal Press, 1964), etc.

That is, an acid process, a neutralization process, an ammonia process, etc., may be used. Also, as the system for reacting a soluble silver salt and a soluble halide, a one side mixing process, a simultaneous mixing process, a combination of them, etc., may be used.

Also, the silver halide emulsion for use in this invention may be prepared by a so-called reverse mixing process for forming silver halide grains in the presence of excessive silver ion. As one of the simultaneous mixing processes, a so-called controlled double jet process wherein pAg in the liquid phase of forming the silver halide is maintained at a constant value can be employed.

The pAg value in the liquid phase for forming silver halide grains differs according to the halogen composition of the silver halide grains but is preferably 7 to 11.

Also, the silver halide grains in the silver halide photographic emulsion for use in this invention may have any desired grain size distribution and may be of a polydisperse system or a monodisperse system. The monodisperse system is a disperse system wherein 95% of the grains have a size within ±60% of the number average grain size, preferably within ±40%. The number average grain size is the number average diameter of the diameters of the projected areas of silver halide grains.

In the case of using the above-described controlled double jet process, a monodisperse type silver halide emulsion wherein the crystal form is regular and the grain sizes are almost uniform can be obtained or furthermore, a silver halide emulsion composed of silver halide grains wherein the (110) plane occupies more than 80% of the whole surface areas can be obtained.

Also, the polydisperse type silver halide emulsion can be easily prepared by an ordinary one side mixing process or simultaneous mixing process.

In the step of growing the silver halide grains, it is preferred to add a silver salt solution and a halide solution so that new crystal nuclei do not form.

The size of the silver halide grains can be controlled by the control of temperature, the selection of the kind and amount of solvent, and the control of the addition rate of a silver salt and a halide which are used for growing the silver halide grains.

Also, by using, if desired, a silver halide solvent during the production of silver halide grains for use in this invention, the grain size distribution and the growing rate of silver halide grains can be controlled. It is preferred that the amount of the solvent is $10^{-3}$ to 1.0% by weight, particularly $10^{-2}$ to $10^{-1}$% by weight of the reaction liquid.

Also, with an increase in the amount of the solvent, the grain size distribution can be monodispersed and the growing rate of the silver halide grains can be increased. Also, the use of the silver halide solvent is useful for increasing the grain size.

Examples of the silver halide solvent for use in this invention are ammonia, thioether, thioureas, potassium thiocyanate, etc. Thioether is described in, for example, U.S. Pat. Nos. 3,271,157, 3,790,387, 3,574,628, etc.

As the production of silver halide grains for use in this invention, a process of increasing the addition rate, addition amount, and addition concentrations of a silver salt solution (e.g., an aqueous silver nitrate solution) and a halide solution (e.g., an aqueous potassium bromide solution), which are added for accelerating the growth of the silver halide grains is preferably used.

These processes are described in, for example, British Pat. No. 1,335,925, U.S. Pat. Nos. 3,672,900, 3,650,757, and 4,242,445, Japanese Patent Application (OPI) Nos. 142329/80, 158124/80 (the term "OPI" as used herein refers to a "published unexamined Japanese patent application open to public inspection"), etc.

As the addition method for silver ion and halogen ion in the case of forming the silver halide grains for use in this invention, in the case of producing, for example, silver bromide crystals, an aqueous solution of silver nitrate and an aqueous solution of potassium bromide are used. That is, the silver ion is usually added in the form of an aqueous solution of a water-soluble silver salt (e.g., silver nitrate) and the halogen ion is usually added in the form of an aqueous solution of a water-soluble halide (e.g., potassium bromide, sodium bromide, potassium chloride, potassium iodide, etc.).

Also, by forming on the surface of seed crystals or nuclei (e.g., an octahedron, a cube, etc.) having various halogen compositions the layer composed of silver bromide or silver iodobromide having a different halogen composition as above, the silver halide grains in this invention can be prepared.

For example, there are (1) silver halide grains wherein the internal nucleus is composed of silver iodobromide and the surface layer is also composed of silver iodobromide, and the content of silver iodide is larger in the surface layer than the internal nucleus and (2) silver halide grains wherein the internal nucleus is composed of silver chloride or silver chlorobromide and the surface layer is composed of silver iodobromide.

Still further, two or more kinds of silver halide grains or silver halide emulsions separately prepared may be mixed when used.

The silver halide grains for use in this invention may be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, a gold salt or a complex salt thereof, etc. The addition amount of the salt is selected according to the purpose of the photographic material.

After the formation of the precipitates of silver halide grains or after physical ripening of the silver halide grains, soluble salts may be removed from the silver halide emulsion by a noodle washing method for washing the emulsion after gelling gelatin of the emulsion or may be removed by a flocculation method utilizing an inorganic salt, an anionic surface active agent, an anionic polymer (e.g., polystyrenesulfonic acid), or a gelatin derivative (e.g., acylated gelatin, carbamoylated gelatin, etc.).

The silver halide emulsions for use in this invention may or may not be chemically sensitized. For the chemical sensitization, the method described in, for example, H. Frieser edited, *Die Grundlagen der Photographischen Prozesse mit Silberhalogeniden,* pages 675–734, published by Akademische Verlagsgesellschaft (1968) can be used.

That is, a sulfur sensitization method using active gelatin or a sulfur-containing compound capable of reacting with silver (e.g., thiosulfates, thioureas, mercapto compounds, rhodanines, etc.); a reduction sensitization method using a reducing material (e.g., stannous salts, amines, hydrazine derivatives, formamidinesulfinic acid, silane compounds, etc.); and a noble metal sensitization method using a noble metal compound (e.g., gold complex salts as well as complex salts of the metals belonging to group VIII of the Periodic Table, such as platinum, iridium, palladium, etc.) can be used individually or as a combination.

Specific examples of the sulfur sensitization method are described in U.S. Pat. Nos. 1,574,944, 2,410,689, 2,278,947, 2,728,668, 3,656,955, etc.; specific examples of the reduction sensitization method are described in U.S. Pat. Nos. 2,983,609, 2,419,974, 4,054,458, etc.; and specific examples of the noble metal sensitization method are described in U.S. Pat. Nos. 2,399,083, 2,448,060, British Pat. No. 618,061, etc.

The silver halide photographic emulsions for use in this invention may contain various compounds for preventing the formation of fog during the production of the photographic materials (after chemical ripening and directly before coating), during the storage of the photographic materials, or during photographic processing of the photographic materials or further for stabilizing the photographic performance of the photographic materials. That is, there are many compounds known as antifoggants or stabilizers, for example, azoles such as benzothiazolium salts, nitroindazoles, triazoles, benzotriazoles, and benzimidazoles (in particular, nitro- or halogen-substituted benzimidazoles); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines; the aforesaid heterocyclic mercapto compounds having a water-soluble group such as a carboxy group and a sulfo group; thioketo compounds such as oxazolinethione; azaindenes such as tetraazaindenes (in particular, 4-hydroxy-substituted (1,3,3*a*,7)tetraazaindenes); benzenethiosulfonic acids; benzenesulfinic acid, etc.

These compounds are described in detail in E. J. Birr, *Stabilization of Photographic Silver Halide Emulsions,* published by The Focal Press (1974), etc.

The silver halide photographic emulsions for use in this invention may be spectrally sensitized to blue light having a relatively longer wavelength, green light, red light or infrared light using sensitizing dyes. As the sensitizing dyes, cyanine dyes, merocyanine dyes, complex cyanine dyes, complex merocyanine dyes, holopolar cyanine dyes, styryl dyes, hemicyanine dyes, oxonol dyes, hemioxonol dyes, etc., can be used. Specific examples of the spectral sensitizing dyes are described in, for example, P. Glafkides, Chimie Photographique, 2nd Edition, Chapters 35 to 41, published by Paul Montel, Paris (1957) and F. M. Hamer, *The Cyanine and Related Compounds,* published by Interscience, U.S. Pat. Nos. 2,503,776, 3,459,553, 3,177,210, and *Research Disclosure,* Vol. 176, 17643 (published December, 1978), Term J of the Paragraph 23-IV, etc.

The photographic material prepared using the silver halide photographic emulsion of this invention may contain water-soluble dyes in the hydrophilic colloid layer as a filter dye or for irradiation prevention or other various purposes. Such a dye includes oxonol dyes, hemioxonol dyes, styryl dyes, merocyanine dyes, cyanine dyes, and azo dyes. Among these dyes, onoxol dyes, hemioxonol dyes, and merocyanine dyes are useful.

The photcgraphic materials prepared using the silver halide photographic emulsions of this invention may contain an inorganic or organic hardening agent in the silver halide photographic emulsion layers and other hydrophilic colloid layers. Examples of the hardening agent are chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.), etc. They can be used individually or as a combination thereof.

The photographic materials prepared using the silver halide photographic emulsions may further contain various surface active agents in the photographic emulsion layers or other hydrophilic colloid layers for various purposes, for example, as a coating aid, as an antistatic agent, for improving sliding property, dispersibility, etc., for preventing adhesion, and for improving photographic properties (e.g., development acceleration, increase of contrast, and sensitization), etc.

Examples of the surface active agents are nonionic surface active agents such as saponin (steroid series), alkylene oxide derivatives (e.g., polyethylene glycol, a polyethylene glycol/polypropylene glycol condensation product, polyethylene glycol alkyl ethers or polyethylene glycol alkylaryl ethers, polyethylene glycol esters, polyethylene glycol sorbitan esters, polyalkylene glycol alkylamines, polyalkylene glycol alkylamides, polyethylene oxide addition products of silicone, etc.), glycidol derivatives (e.g., alkenylsuccinic acid polyglyceride, alkylphenol polyglyceride, etc.), fatty acid esters of polyhydric alcohols, alkyl esters of sugar, etc.; anionic surface active agents containing an acid group such as a carboxy group, a sulfo group, a phospho group, a sulfuric acid ester group, a phosphoric acid ester group, etc., for example, alkyl carboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine oxides, etc.; and cationic active agents such as alkylamine salts, aliphatic or aromatic quaternary ammonium salts, heterocyclic quaternary ammonium salts such as pyridinium, imidazolium, etc., and aliphatic ring or heterocyclic ring-containing phosphonium salts or sulfonium salts.

Furthermore, the photographic materials prepared using the silver halide photographic emulsions of this invention may contain polyalkylene oxide or the derivatives thereof, such as the ethers, esters, amines, etc., thioether compounds, thiomorpholines, quaternary ammonium salt compounds, urethane derivatives, urea derivatives, imidazole derivatives, 3-pyrazolidones, etc., in the silver halide photographic emulsion layers for purposes of increasing the sensitivity, increasing the contrast, or accelerating development. Examples of these compounds are described in, for example, U.S. Pat. Nos. 2,400,532, 2,423,549, 2,716,062, 3,617,280, 3,772,021, 3,808,003, British Pat. No. 1,488,991, etc.

As a hydrophilic colloid or a binder which is used for the silver halide emulsion layer or an intermediate layer in this invention, gelatin is advantageously used but other hydrophilic colloids as mentioned before may be used.

The silver halide photographic emulsions of this invention may further contain color-forming couplers, that is, the compounds capable of coloring by oxidative coupling with an aromatic primary amine developing agent (e.g., phenylenediamine derivatives and aminophenol derivatives) in color development processes.

Examples of these couplers are magenta couplers such as 5-pyrazolone couplers, pyrazolobenzimidazole couplers, cyanoacetylcumarone couplers, open chain acylacetonitrile couplers, etc.; yellow couplers such as acylacetamide couplers (e.g., benzoylacetanilides, pivaloylacetanilides, etc.), etc.; cyan couplers such as naphthol couplers, phenol couplers, etc.

It is preferred that these couplers are non-diffusible couplers having a hydrophobic group called a ballast group in the molecule. The couplers may be of 4-equivalent or 2-equivalent to silver ion.

Also, colored couplers having a color correction effect or so-called DIR couplers, i.e., couplers releasing a development inhibitor with the progress of development may be used.

Furthermore, non-coloring DIR coupling compounds which provide the colorless coupling reaction products and release development inhibitors may be used as well as the DIR couplers.

The photographic materials prepared using the silver halide emulsions of this invention may further contain hydroquinone derivatives, aminophenol derivatives, gallic acid derivatives, ascorbic acid derivatives, etc., as color fogging preventing agents.

The photographic materials prepared using the silver halide photographic emulsions of this invention may contain an ultraviolet absorbent in the hydrophilic colloid layer. Examples of the ultraviolet absorbent are benzotriazole compounds substituted by an aryl group (as described in, for example, U.S. Pat. No. 3,533,793), 4-thiazolidone compounds (as described in U.S. Pat. Nos. 3,314,794, 3,352,681, etc.), benzophenone compounds (as described in Japanese Patent Application (OPI) No. 2784/71), cinnamic acid ester compounds (as described in U.S. Pat. Nos. 3,705,805, 3,707,375, etc.), butadiene compounds (as described in U.S. Pat. No. 4,045,229), and benzoxidole compounds (as described in U.S. Pat. No. 3,700,455). Furthermore, the compounds described in U.S. Pat. No. 3,499,762 and Japanese Patent Application (OPI) No. 48535/79 can be used as the ultraviolet absorbent. Also, ultraviolet absorbing couplers (e.g., α-naphtholic cyan dye forming couplers) and ultraviolet absorbing polymers may be used. These ultraviolet absorbers may be mordanted to a specific layer.

In this invention, the following known fading preventing agents may be used together and color image stabilizers may be used solely or in combination. As the fading preventing agent, there are hydroquinone derivatives, gallic acid derivatives, p-alkoxyphenols, p-oxyphenol derivatives, and bisphenols.

Moreover, the silver halide photographic emulsions of this invention can contain various additives such as whitening agents, desensitizers, plasticizers, lubricants, matting agents, oils, mordants, etc.

These additives are practically described in *Research Disclosure,* Vol. 176, pages 21–31 (RD-17643) (Dec., 1978).

The silver halide photographic emulsions of this invention can be used for various color and black-and-white silver halide photographic materials. For example, the emulsions of this invention can be used as color positive emulsions, emulsions for color photographic papers, color negative emulsions, color reversal emulsions (containing or not containing couplers), emulsions for graphic photographic materials (e.g., lithographic films), emulsions for CRT display photographic materials, emulsions for radiographic photographic materials (in particular, direct photographing materials using intensifying screens and indirect photographing materials) as well as emulsions for colloid transfer processes, silver salt diffusion transfer processes, dye transfer processes, silver dye bleaching processes, print out photographic materials, heat development photographic materials, etc.

The light exposure for obtaining photographic images may be performed in an ordinary manner. That is, various light sources including infrared light, such as natural light (sunlight), a tungsten lamp, a fluorescent lamp, a mercury lamp, a xenon arc lamp, a carbon arc lamp, a xenon flash lamp, a cathode ray flying spot, a light emitting diode, laser light (e.g., gas laser, YAG laser, dye laser, semiconductor laser, etc.), etc., can be used. Also, the light emitted from a fluorescent substance excited by electron rays, X-rays, γ-rays, α-rays, etc., can be used.

The exposure time is from 1/1,000 sec. to 1 sec. using an ordinary camera. However, the light exposure time may be shorter than 1/1,000 sec., e.g., $1/10^4$ to $1/10^6$ sec. as in the case of using a xenon flash lamp or a cathode ray tube, or may be longer than 1 sec. If desired, the spectral composition of light used for the exposure can be controlled by using color filters.

For processing the photographic materials prepared by using the silver halide emulsions of this invention, the known processes and known processing liquids described in, for example, *Research Disclosure*, Vol. 176, pages 28–30 (RD-17643) can be applied. The photographic processing may be, according to the purpose, a photographic process for forming silver images (black-and-white development process) and a photographic process for forming dye images (color photographic process). The processing temperature is usually selected in the range of 18° C. to 50° C. but may be lower than 18° C. or may be higher than 50° C.

Also, as the case may be, other development processes (e.g., heat development) can be used.

Typical examples of this invention are illustrated below, but are not meant to be limiting. Unless otherwise specified, all percents, etc., are by weight.

EXAMPLE 1

For the crystal control compounds of this invention and Comparison Compounds (a) to (d) shown in Table 1 below, the physical retardances were measured by the physical retardance measuring method described above in this specification. In addition, the measurement was performed at pH 5.

Then, silver halide emulsions were prepared by the following process and the acceleration action for developing the (110) plane was evaluated on each compound.

That is, while stirring well 1,000 ml of an aqueous 2% gelatin solution (containing 20 ml of an aqueous 25% ammonia solution), 1,000 ml of an aqueous silver nitrate solution (containing 100 g of silver nitrate) and an aqueous potassium bromide solution (containing a necessary sufficient amount of potassium bromide) were added to the aqueous gelatin solution at 50° C. by a controlled double jet method over a period of 40 minutes.

The addition rate of the aqueous potassium bromide solution was controlled so that the pAg value in the reaction vessel was always maintained at 10.0 during the addition thereof.

The silver halide emulsion thus obtained was regular octahedron grains having a mean grain size (the diameter of the projected sectional area measured by a TGZ-3 measuring device made by Carl Zeiss A.G. in West Germany) of 0.85 μm and composed of the (111) plane.

The silver halide emulsion thus obtained was split into equal portions and after dispersing each portion in 1,000 ml of water (containing 30 ml of 25% ammonia) and 0.6 mmol/mol of silver halide of the compound shown in Table 1 was added to the mixture, 1,000 ml of an aqueous solution containing 80 g of silver nitrate and an aqueous potassium bromide solution containing a necessary sufficient amount of potassium bromide were added to the mixture at 50° C. by a controlled double jet method over a period of 40 minutes while maintaining the pAg value at 10.0.

The external form of the silver halide grains contained each silver halide emulsion thus obtained was observed by an electronmicroscope. The results thus obtained are shown in Table 1.

In addition, the following compounds were used as the comparison compounds.

Comparison Compound (a):

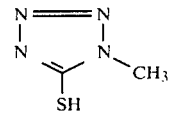

Comparison Compound (b):

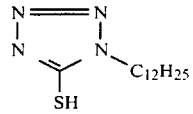

Comparison Compound (c):

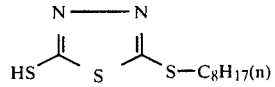

Comparison Compound (d):

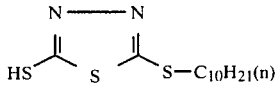

TABLE 1

| Sample No. | Compound | Physical Retardance (pH 5) | External form of Silver Halide Grains | Note |
|---|---|---|---|---|
| 1 | (3) | 90 | Rhombic dodecahedron | This Invention |
| 2 | (4) | 90 | Rhombic dodecahedron | This Invention |
| 3 | (5) | 90 | Rhombic dodecahedron | This Invention |
| 4 | (6) | 80 | Rhombic dodecahedron | This Invention |
| 5 | (10) | 90 | Rhombic dodecahedron | This Invention |
| 6 | (13) | 90 | Rhombic dodecahedron | This Invention |
| 7 | (15) | 100 | Rhombic dodecahedron | This Invention |
| 8 | (17) | 90 | Rhombic dodecahedron | This Invention |
| 9 | (39) | 90 | Rhombic dodecahedron | This Invention |
| 10 | (40) | 100 | Rhombic dodecahedron | This Invention |
| 11 | (41) | 90 | Rhombic dodecahedron | This Invention |
| 12 | (42) | 90 | Rhombic dodecahedron | This Invention |
| 13 | (43) | 80 | Rhombic dodecahedron | This Invention |
| 14 | Comparison Compound (a) | 0 | Regular octahedron | |
| 15 | Comparison Compound (b) | 40 | Round regular octahedron | |
| 16 | Comparison Compound (c) | 30 | Round regular octahedron | |
| 17 | Comparison Compound (d) | 0 | Regular octahedron | |

As is clear from the results shown in Table 1, by using the crystal control compounds of this invention having a physical retardance of higher than 70, silver halide photographic emulsions containing silver bromide grains of a rhombic dodecahedron could be prepared. That is, by using the crystal control compounds of this invention, the (110) plane could be remarkably developed.

EXAMPLE 2

After stirring well 1,000 ml of an aqueous 2% gelatin solution (containing 20 ml of an aqueous 25% ammonia solution), 1,000 ml of an aqueous silver nitrate solution (containing 100 g of silver nitrate) and an aqueous potassium bromide solution (containing a necessary sufficient amount of potassium bromide) were added to the gelatin solution at 50° C. by a controlled double jet method over a period of 40 minutes.

The addition rate of the aqueous potassium bromide solution was controlled so that the pAg value in the reaction vessel was maintained at 10.0 during the addition thereof.

The silver halide emulsion thus obtained was regular octahedron grains having a mean grain size (the diameter of the projected sectional area measured by TGZ-3 measuring device made by Carl Zeiss A.G. in West Germany) of 0.85 μm and composed of the (111) crystal plane.

Then, the silver halide emulsion thus obtained was split into two portions (each containing silver bromide corresponding to 50 g of silver nitrate) and each portion was dispersed in 1,000 ml of water (containing 30 ml of 25% ammonia). Then, 75 ml of a methanol solution of 0.1% Compound (13) of this invention was added to one dispersion, the same amount of methanol containing no crystal control compound was added to the other dispersion, and the growth of silver halide grains was continued for both the mixtures as follows. That is, 1,000 ml of an aqueous solution containing 80 g of silver nitrate and an aqueous potassium bromide solution containing a necessary sufficient amount of potassium bromide were added to each mixture at 50° C. by a controlled double jet method over a period of 40 minutes while maintaining the pAg value at 10.0.

Figure 2:
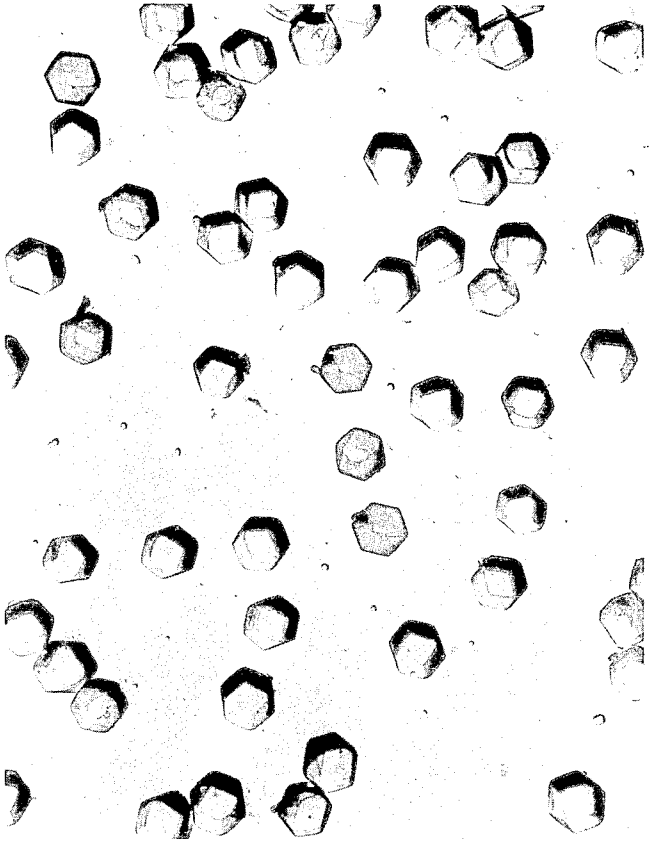
FIG. 2 is the electronmicroscopic photograph of 10,000 magnification of silver halide emulsion B containing rhombic dodecahedral silver bromide grains composed of the (110) plane produced in Example 2.

The silver halide emulsion (Emulsion A) containing no crystal control compound thus obtained was a regular octahedron (FIG. 1) wherein the external form of the silver halide grains was composed of the (111) crystal plane. On the other hand, the silver halide emulsion (Emulsion B) containing Compound (13) of this invention was an almost rhombic dodecahedron wherein the external form of the grains was composed of the (110) crystal plane (FIG. 2.).

EXAMPLE 3

By following the same procedure as Example 2 except that the addition rate of the aqueous solution of potassium bromide was controlled so that the pAg value in the reaction vessel was always maintained at 8.0, silver halide emulsions were prepared.

Figure 3:
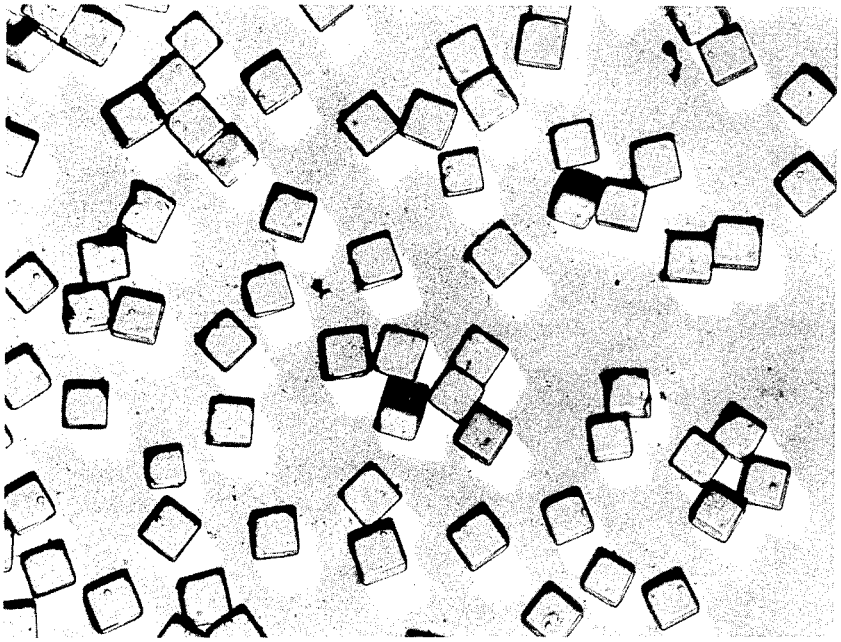
FIG. 3 is the electronmicroscopic photograph of 10,000 magnification of silver halide emulsion C containing cubic silver bromide grains composed of the (100) crystal plane produced in Example 3.
Figure 4:
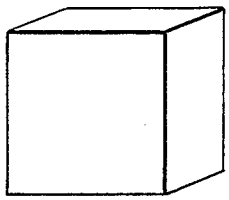
FIG. 4 to FIG. 6 show the crystal forms of a (100) plane regular hexahedron, a (110) plane rhombic dodecahedron, and a (111) plane regular octahedron, respectively.
Figure 5:
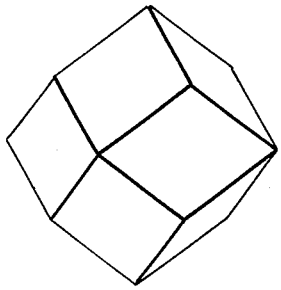
Figure 6:
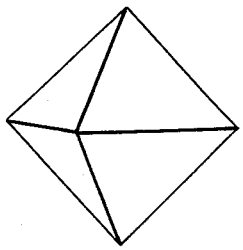
Figure 7:
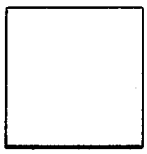
FIG. 7 to FIG. 9 show the plane projection illustrations of a (100) plane regular hexahedron, a (110) plane rhombic dodecahedron, and a (111) plane regular octahedron, respectively.
Figure 8:
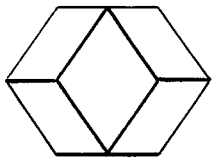
Figure 9:
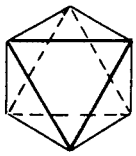
Figure 10:
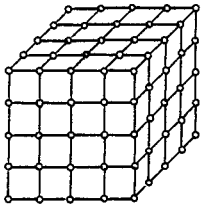
FIG. 10 to FIG. 12 show the atomic arrangements of a (100) plane regular hexahedron, a (110) plane rhombic dodecahedron, and a (111) plane regular octahedron, respectively.
Figure 11:
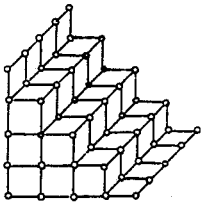
Figure 12:
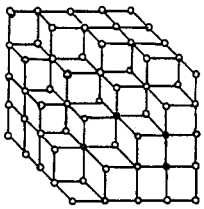
Figure 13:
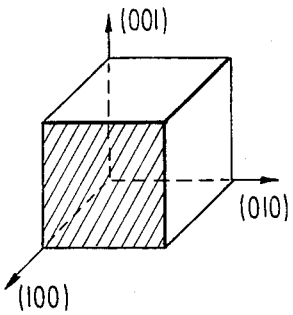
FIG. 13 to FIG. 15 show the crystal axes and the crystal planes of a (100) plane regular hexahedron, a (110) plane rhombic dodecahedron, and a (111) plane regular octahedron, respectively.
Figure 14:
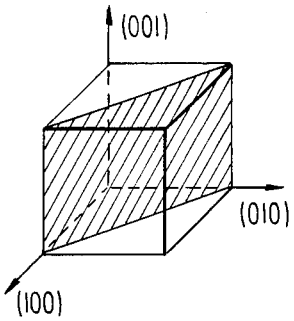
Figure 15:
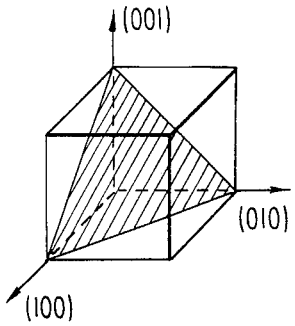

In this case, the silver halide emulsion (Emulsion C) containing no Compound (13) of this invention was a cubic form wherein the external form of the silver halide grains was composed of the (100) plane (FIG. 3), while the silver halide emulsion (same as Emulsion B) containing Compound (13) of this invention was an almost complete rhombic dodecahedron wherein the external form of the silver halide grains was composed of the (110) crystal plane.

In addition, the sensitivities and fogs of the silver halide emulsions prepared in Examples 2 and 3 are shown in Table 2, taking the sensitivity of Emulsion B before chemical sensitization as 100.

As is clear from the results shown in Table 2, it can be seen that Emulsion B of this invention having the (110) plane could remarkably restrain the formation of fog at the same sensitivity.

EXAMPLE 4

After desalting three kinds of Emulsions A, B and C obtained in Examples 2 and 3 by an ordinary method, gelatin was added to each emulsion followed by redissolving. After gold and sulfur sensitizing the resulting emulsions with sodium thiosulfate, potassium thiocyanate and potassium chloroaurate, respectively at the same pH value (6.5), the same pAg value (8.6), and the same temperature (60° C.), each emulsion was coated on a cellulose acetate film without the addition of a spectral sensitizing dye and dried.

Then, after applying white light exposure to each photographic film thus prepared through an optical wedge, each film was developed using a D-19 developer (made by Eastman Kodak Co.) for 10 minutes at 20° C. Then, the fog values after the chemical sensitization were compared at the same sensitivity and the results thus obtained are shown in Table 2.

TABLE 2

| Photographic Property | (111) Plane Emulsion A | (110) Plane Emulsion B | (100) Plane Emulsion C |
|---|---|---|---|
| Sensitivity before chemical sensitization | 400 | 100 (standard) | 400 |
| Fog before chemical ripening | 0.04 | 0.02 | 0.06 |
| Sensitivity after chemical sensitization | 800 | 800 | 800 |
| Fog after chemical sensitization | 0.07 | 0.02 | 0.10 |
| Crystal planes of silver halide grains | FIGS. 4, 7, 10 and 13 | FIGS. 5, 8, 11 and 14 | FIGS. 6, 9, 12 and 15 |

EXAMPLE 5

To each of the three kinds of Emulsions A, B and C obtained in Example 4 was added a sensitizing dye, 3,3'-diethyl-9-methyl thiacarbocyanine and after allowing the emulsions to stand for 30 minutes at 40° C., each emulsion was coated on a cellulose acetate film support and dried.

Figure 16:
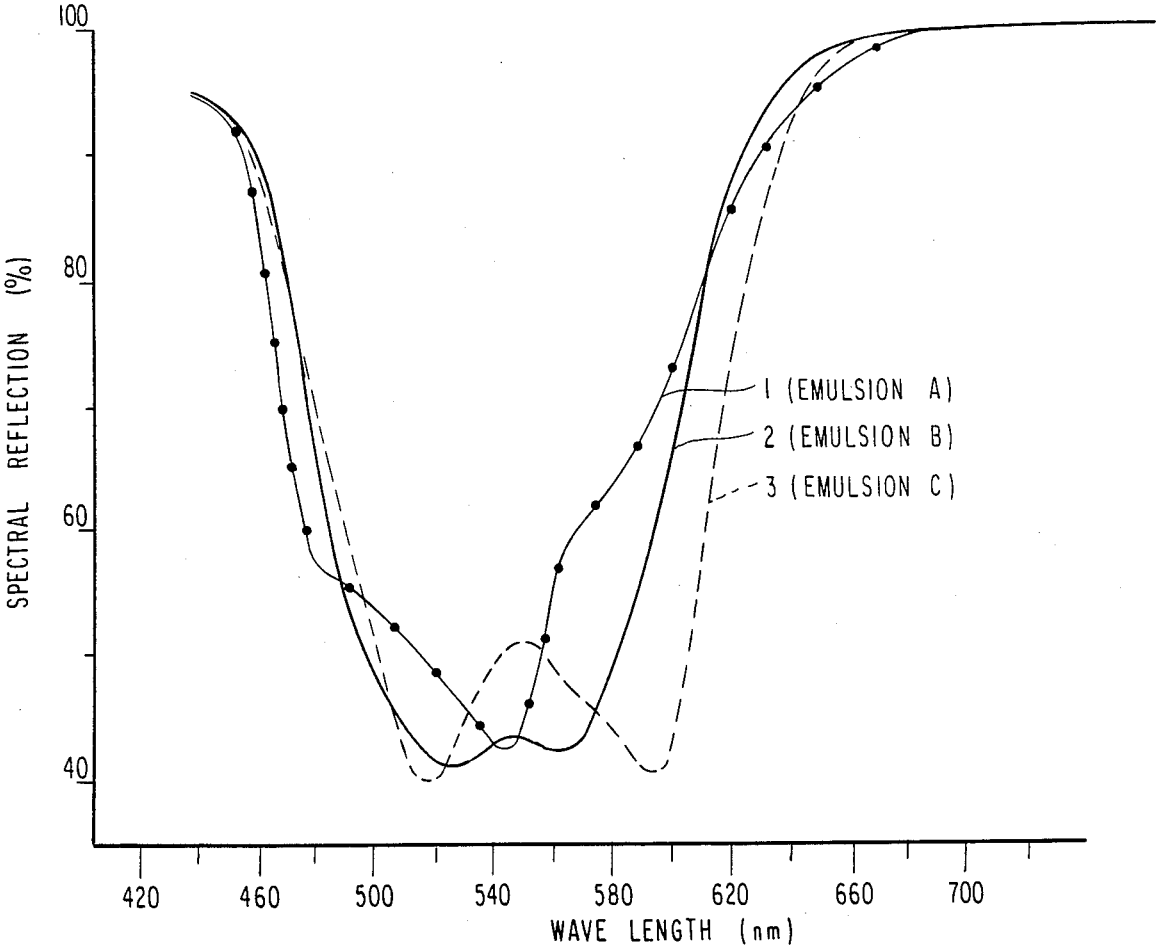
FIG. 16 is a graph showing the spectral reflection spectra of the silver halide emulsions A, B and C in Example 5.

About the spectral reflection spectra data of the coated samples thus obtained, the spectral reflection spectra of the samples showing almost the same minimum reflectance (about 40%) were compared and the results are shown in FIG. 16.

From the results shown in FIG. 16, it can be seen that Emulsion B composed of the (110) crystal plane shows clearly different spectral characteristics from those of Emulsion A composed of the (111) crystal plane and Emulsion C composed of the (100) crystal plane. That is, in the spectral reflection spectrum of the silver halide emulsion of this invention composed of the (110) crystal plane, the form of the reflection spectrum is almost a stand form as compared to the silver halide emulsions composed of other crystal planes, which show that the silver halide emulsion having improved color reproducibility can be obtained.

EXAMPLE 6

By following the same procedure as in the case of producing Emulsion B in Example 2 except that an aqueous solution of potassium bromide and 5 mol % potassium iodide was used in place of the aqueous solution of potassium bromide, a silver halide photographic emulsion composed of silver iodobromide grains containing 5 mol % silver iodide was obtained. The photographic emulsion was composed of regular rhombic dodecahedron grains composed of the (110) crystal plane.

EXAMPLE 7

By following the same procedure as in the case of producing Emulsion B in Example 2 except that an aqueous solution of potassium bromide and 15 mol % potassium iodide was used in place of the aqueous solution of potassium bromide, a silver halide photographic emulsion composed of silver iodobromide grains containing 15 mol % silver iodide was obtained. The photographic emulsion was composed of regular rhombic dodecahedron grains composed of the (110) crystal plane.

EXAMPLE 8

By following the same procedure as the case of producing Emulsion B in Example 2 except for using Compound (40) of this invention in place of Compound (13) of this invention, a silver bromide photographic emulsion was prepared. The photographic emulsion was regular rhombic dodecahedron grains composed of the (110) crystal plane.

EXAMPLE 9

By following the same procedure as in Example 6 except for using Compound (40) of this invention in place of Compound (13) of this invention, a silver iodobromide emulsion was prepared. The emulsion was composed of regular rhombic dodecahedron grains composed of the (110) crystal plane.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing silver halide grains the surface of which is a (110) crystal plane substantially composed of silver iodobromide.

2. A process for producing a silver halide photographic emulsion containing silver halide grains the surface of which is substantially composed of silver iodobromide, which comprises performing growth of the silver halide grains in an aqueous medium in the presence of a hydrophilic protective colloid and at least one compound accelerating the development of a (110) crystal plane.

3. A silver halide photographic emulsion containing a silver halide grains the surface of which is substantially composed of silver iodobromide, said emulsion being prepared by performing growth of the silver halide grains in an aqueous medium in the presence of a hydrophilic protective colloid and at least one compound accelerating the development of a (110) crystal plane.

4. A silver halide photographic emulsion containing silver halide grains the surface of which is a (110) crystal plane, wherein the silver halide is solely silver bromide.

5. A silver halide photographic emulsion as containing silver halide grains the surface of which is a (110) crystal plane, wherein the silver halide is solely silver iodobromide.

6. A process for producing a silver halide photographic emulsion containing silver halide grains, wherein the silver halide is solely silver bromide, which comprises performing growth of the silver bromide grains in an aqueous medium in the presence of a hydrophilic protective colloid and at least one compound accelerating the development of a (110) crystal plane.

7. A process for producing a silver halide photographic emulsion containing silver halide grains, wherein the silver halide is solely silver iodobromide, which comprises performing growth of the silver iodobromide grains in an aqueous medium in the presence of a hydrophilic protective colloid and at least one compound accelerating the development of a (110) crystal plane.

* * * * *